US005822933A

United States Patent [19]

Burroughs et al.

[11] Patent Number: 5,822,933

[45] Date of Patent: Oct. 20, 1998

[54] METHOD AND APPARATUS FOR WALL DRAINAGE

[75] Inventors: Mark E. Burroughs, Supply; Chris E. Cooper, Wilmington, both of N.C.

[73] Assignee: Advanced Construction Technologies, Inc., Wrightsville Beach, N.C.

[21] Appl. No.: 787,606

[22] Filed: Jan. 23, 1997

[51] Int. Cl.[6] ..... E06B 7/14; E04B 1/70

[52] U.S. Cl. ..... 52/209; 52/302.6; 52/204.5; 52/95; 52/402; 49/408; 49/476.1

[58] Field of Search ..... 52/302.1, 302.2, 52/302.6, 302.7, 209, 169.11, 94, 95, 204.5, 402; 49/408, 471, 476.1

[56] References Cited

U.S. PATENT DOCUMENTS

| | | | |
|---|---|---|---|
| 1,677,130 | 7/1928 | Cherry | 52/209 |
| 1,954,730 | 4/1934 | Erickson . | |
| 2,789,493 | 4/1957 | Riggle . | |
| 2,963,126 | 12/1960 | Cudini . | |
| 3,343,323 | 9/1967 | Mayfield . | |
| 3,793,931 | 2/1974 | Wild . | |
| 3,919,815 | 11/1975 | Alabaster | 52/209 X |
| 4,154,033 | 5/1979 | Krueger et al. | 52/209 |
| 4,282,691 | 8/1981 | Risdon . | |
| 4,555,882 | 12/1985 | Moffitt et al. . | |
| 4,607,566 | 8/1986 | Boottomore et al. | 52/302.6 X |
| 4,660,463 | 4/1987 | Bottomore et al. | 52/95 X |
| 4,691,487 | 9/1987 | Kessler . | |
| 4,715,152 | 12/1987 | Tanikawa . | |
| 4,745,710 | 5/1988 | Davis | 52/94 X |
| 5,123,212 | 6/1992 | Dallaire et al. | 52/209 |

FOREIGN PATENT DOCUMENTS

| | | | |
|---|---|---|---|
| 2547608 | 12/1984 | France | 52/302.6 |
| 799964 | 8/1958 | United Kingdom | 52/209 |
| 1375171 | 11/1974 | United Kingdom | 49/408 |

*Primary Examiner*—Winnie S. Yip
*Attorney, Agent, or Firm*—Rhodes Coats & Bennett, L.L.P.

[57] ABSTRACT

Water is prevented from entering the wall interior of a building from in and around a wall component, such as a window, mounted in the building wall, by positioning a diverter directly beneath the wall component. The diverter includes an upper surface that slopes toward the wall exterior, a plurality of spaced, parallel ribs extending upwardly from the upper surface and beyond the exterior wall to form a plurality of downwardly sloping channels, a cover over the outer ends of the ribs to form drainage openings at the ends of the channels, and filters in the channels to prevent water from entering the wall interior through the channels.

19 Claims, 2 Drawing Sheets

METHOD AND APPARATUS FOR WALL DRAINAGE

BACKGROUND OF THE INVENTION (1) Field of the Invention

The present invention relates generally to a method and apparatus for removing water from the interior of a wall, and in particular to a method and apparatus for preventing water entering at windows and other components of a building wall from collecting within the wall interior.

(2) Description of the Prior Art

Water in the form of rainwater, ice, snow, or the like, penetrates in and around building wall components, e.g., windows and doors, and then migrates downwardly beneath the wall component resulting in high moisture in the wall interior. In traditional building construction where the walls are formed of a wood frame with an outer cladding of wood, brick or concrete, this moisture has created some problems, although the porosity of the cladding allows the moisture to escape. Also, openings in the exterior of the walls, either due to the nature of the materials used, or the addition of ventilation openings, have aided in moisture removal.

In more modern construction, however, there is a trend toward the use of cladding materials that result in a building that is as air tight as possible. These materials include, for example, exterior insulation and finish systems (EIFS), insulated brick, polyethylene sheeting, and polyvinyl siding. With these non-porous cladding materials, moisture entering the wall interior may be trapped, creating a highly moist environment that causes the wood frame components of the building to rot, and metal components to rust or corrode. In addition, the moist environment is a breeding ground for wood consuming insects, causing further decay. This problem is accelerated in hot and humid environments.

Attempts have been made to prevent entry of water into the building wall interior by sealing or caulking entry points in and around wall components as the primary defense against water intrusion, or by installing flashing around the wall components to divert the water. These attempts have not been completely successful. Sealants are not only difficult to properly install, but tend to separate from the wall component or wall due to climatic conditions, building movement, the surface type, or chemical reactions. Flashing is also difficult to install and may tend to hold the water against the wall component, accelerating the decay.

The use of sealants and flashing is also limited to the attempted minimization of water collection in building walls in new construction, and the further collection in existing structures. These materials are of no value in addressing the problem of water that has already entered a building wall interior. Thus, with solutions presented in the prior art, water still enters the wall interior, and the problem is further compounded by the prevention of any evaporation of the water already in the wall interior.

The problem of water penetration has prevented the full use of new building cladding materials, and has resulted in many buildings with rotting framing structures, requiring extensive and expensive retrofitting. Thus, there is a great need for an apparatus and method to prevent water from entering the wall interior of a building at wall components, and for the removal of water that has already collected within the wall interior. As used herein, the term "water" refers to both liquid and airborne forms of water, while moisture is intended to refer to the water carried by the air in a humid environment.

SUMMARY OF THE INVENTION

The present invention is directed to a method and apparatus for preventing water from entering into the wall interior of a building, and for allowing water or moisture within a wall interior to escape. The invention relates especially to a method and apparatus that diverts water from beneath a wall component to the exterior of a building wall, and provides exterior ventilation of a wall interior without the entrance of water from the building exterior.

The walls of modern residential buildings, and some commercial buildings, are comprised of a structural frame, e.g., a wood frame, having an inner face covered with an interior covering and an outer face covered with an exterior covering. The interior covering may be of various materials, such as sheet rock or paneling. The exterior covering may be formed of an interior sheathing of plywood or sheet rock that is covered with cladding, e.g., a coated insulation board.

Water entering in and around wall component migrates beneath the wall component and then between the space between the interior and exterior coverings as well as between the sheathing and the cladding. The term "wall interior" as used herein refers to water penetrable spaces in the wall structure-, including the wall cavity between the interior and exterior coverings and any space between the sheathing and the cladding.

The term "wall components," as used herein includes windows, doors, and other building components or attachments that are mounted in an openings in a building wall. The present invention will be described in the context of a window fitted into an opening in the wood frame wall of a residential structure. It is to be understood, however, the invention is also applicable to other wall components and to other types of buildings.

Windows used in the construction of modern buildings are usually formed of an outer frame having a horizontal lower section or sill; a horizontal upper section or header; and two vertical side sections or jambs. When mounted in a wall opening, the outer edges of the window are covered with a frame or brick mould. The window construction may also include horizontal or vertical mullions. The window sections can be formed of wood, or of extrusions of aluminum, or of a synthetic resin, such a polyvinyl chloride. The ends of each section are joined with screws or other fasteners. At least one sash comprised of an outer frame and glass or glazing is secured within the frame. Caulking or sealant, such as a silicone sealant, is used to fill any gaps at the section joints and between the glass and the section. Flexible members are used between the sash and window frame sections to prevent the entrance of moisture.

The window is positioned within an opening in the wall, with sections of the wood building frame along the edges of the opening. The frame sections include a horizontal rough frame sill along the bottom edge of the opening, a horizontal header along the top edge of the opening, and vertical studs along the sides of the opening. Other vertical studs or cripples, may be positioned beneath the frame sill. The window is inserted into the wall opening, and the window frame is secured with screws of other fasteners through the cladding to the wooden frame.

Despite prior attempts to prevent leakage, water still enters through openings in and around the window, especially at the mullions and at miters where sections are joined, and drips or migrates downwardly into the wall interior. The resultant moist environment causes the wood framing in the interior to rot and metal components to rust or corrode.

The present invention addresses this problem by inserting a water removal diverter in the wall and beneath the window sill, so that water entering the window and migrating or dripping toward the part of the wall interior beneath the window will be collected by the diverter and directed outwardly to the building exterior. The diverter additionally provides for ventilation, so that water within the wall interior prior to insertion of the diverter can evaporate. Thus, after insertion of the diverter, further collection of moisture in the wall interior is prevented. In addition, the wall interior, particular adjacent the diverter and the lower surface of the wall component is ventilated, aiding in reduction of the moisture level in the wall interior.

Basically, the diverter includes a plate having parallel rear and front edges; a planar, horizontal lower surface adapted to rest on the wall frame; and a upper water diverting surface extending downwardly from the rear edge to the front edge of the plate. A flange or stop extends downward from the front edge of the plate to position the plate when it is inserted into a wall opening. The front edge extends at least to, i.e., to or beyond, the exterior surface of the wall cladding.

Since the diverter will be positioned directly under a window or other wall component that has previously been supported by a sill, the diverter also may include a wall component support extending upwardly from the plate. Preferably, the support is in the form of a plurality of spaced, parallel ribs or upwardly extending segments having lower edges integral with the plate, and upper surfaces parallel to the plate's lower surface. These ribs preferably extend from the inner edge of the plate to beyond the plate's outer edge, with the outer ends of the ribs being angled downwardly, e.g., at an angle of about 30° to about 60°. A covering plate or water shield having a rear edge abutting the exterior wall surface is fixed over the angled ends of the ribs.

Thus, the ribs in combination with the plate's lower surface form a plurality of parallel channels of increasing depth that begin at the rear of the diverter and extend toward the front of the diverter. Since the upper surface of the plate terminates short of the ends of the ribs, and since the angled ends of the ribs are covered by a covering plate, discharge openings are formed at the ends of the channels beneath the covering plate, so that water will flow along the channels and out of the discharge openings. In order to prevent water from entering through the discharge openings, e.g., in a rainstorm, baffles or filters are placed over the discharge openings.

A variety of baffle or filter constructions may be used, provided that the material allows water from the building interior to flow or wick to the building exterior, while preventing water from entering the building. For example, a suitable filter can be in the form of a bundle or rod of a synthetic fibers, such as cellulose acetate fibers. This filter should be of a dimension such that it will snugly fit within a channel of the diverter. Other materials suitable for this purpose will occur to one skilled in the art. The filter also serves to insulate the wall interior from differences in outside temperatures.

In order to prevent water from entering the wall interior from the window, the diverter is positioned beneath at least the front part of the wall component, so that water will be collected on the upper surface of the plate. The exterior or outer edge of the plate extends at least to the exterior surface of the wall, with the stop fitting against the wall's exterior. In this position, the covered rib ends and discharge openings project beyond the wall, so that water will be discharged to the exterior of the building.

When the diverter is to be installed into a previously constructed building, a horizontal slot having a width at least equal to the width of the window or other wall component, and a height corresponding to the height of the diverter, is cut into the wall directly beneath the lower edge of the wall component. The depth of the slot is sufficient to allow insertion of the diverter far enough for the stop to engage the wall. Therefore, a portion of the rough frame sill normally beneath the wall component will be removed. A part of the rough sill will normally remain to support the wall component. The diverter is then inserted into the slot as noted above. When in position, the lower surface of the wall component, e.g., the sill of a window, will rest against the upper surfaces of the ribs. Any gap between the edges of the diverter and the wall are then sealed to prevent water from entering the wall around the diverter.

The diverter should be long enough to extend horizontally beneath the entire width of the wall component, and preferably should be long enough to extend beyond either side of the wall component, e.g., by about 1 inch or more. The diverter can be manufactured commercially in a standard length, and cut to the desired length. Also, sections of the diverter can be joined at their ends by a suitable adhesive or with interlocking ends, to form a longer diverter than the standard length.

The height of the diverter is not critical, but will normally be from about 0.50 to about 0.75 inches. The depth of the diverter will be sufficient to extend far enough under the wall component to collect water entering at the front of the wall component and migrating downward to the wall component's lower surface. The diverter may extend into the wall at depth up to the thickness of the exterior wall, plus the thickness of the wall frame.

The diverter can be manufactured from a variety of materials, so long as the material is water impervious. Preferably, the diverter is molded from a synthetic resin, e.g., polyvinyl chloride.

Accordingly, one aspect of the present invention is to provide a diverter that can be positioned in a wall and beneath a wall component to collect water entering through and around the wall component and direct the water to the wall's exterior. The diverter may additionally include means for preventing moisture from entering the wall interior through the diverter from the exterior of the building.

Another aspect of the present invention is to provide a building that includes a wall with a wall component, and a water removal diverter in the wall beneath the wall component to prevent water from entering the wall interior.

Still another aspect of the present invention is to provide a method for preventing water from entering the wall interior at a wall component, by inserting a water removal diverter in the wall beneath the wall component and removing water from the wall to the wall exterior.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation.

Figure 1:
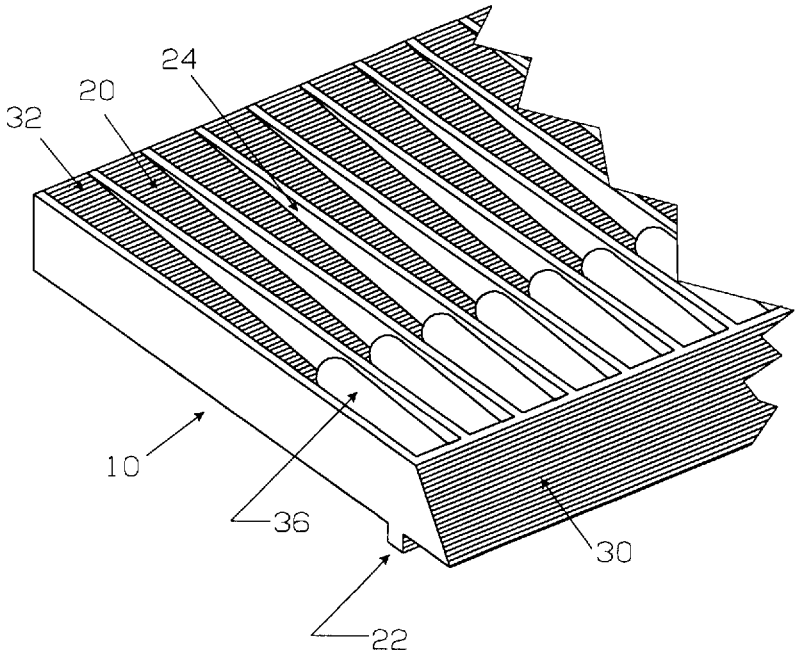
FIG. 1 is a perspective view of the diverter.
Figure 2:
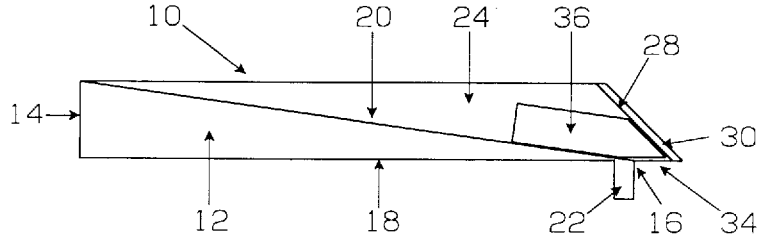
FIG. 2 is a sectional side view of the diverter of FIG. 1, along line 2—2.

As best shown in FIGS. 1 and 2, the diverter, generally 10, is comprised a base plate 12 having parallel rear and front edges 14 and 16; a planar, horizontal lower surface 18; and a upper water diverting surface 20, extending outwardly and downwardly from the back to the front of plate 12. Stop 22 extends vertically downward from front edge 16 of plate 12 to position diverter 10 into a wall opening.

A plurality of spaced, parallel ribs 24 with upper surfaces parallel to lower surface 18 project upwardly from upper surface 20. The upper surfaces of ribs 24 should be narrow or curved to prevent water from migrating back along the surfaces into the wall interior. Outer ends 28 of ribs 24 terminate at a downward angle of preferably about 45° and are covered with covering plate 30.

Ribs 24 in combination with surface 20 form a plurality of parallel channels 32 that extend downwardly and outwardly from rear edge 14 of plate 12 to front edge 16. Ends 28 of ribs 24 extend beyond plate 12 and, in combination with cover plate 30 form a discharge opening 34 at the end of each channel 32. A filter 36 is positioned in each channel 32 at discharge opening 34 to prevent water, debris and insects from entering through the openings 34.

Figure 3:
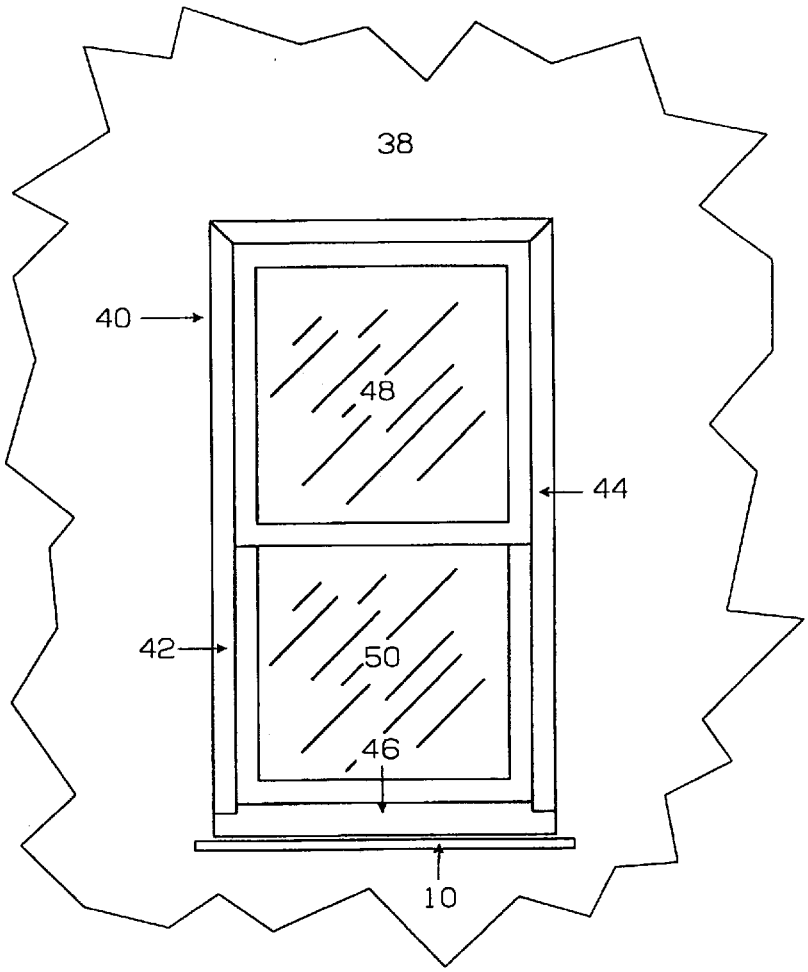
FIG. 3 is a front view of a wall illustrating the placement of the diverter beneath a window.

FIG. 3 shows placement of diverter 10 in a wall 38 beneath a window, generally 40, that includes brick mould 42 and 44, and a sill 46. Sashes 48 and 50 are slidably mounted between a jamb, not shown, and jamb 45, behind brick mould sections 42 and 44, respectively.

Figure 4:
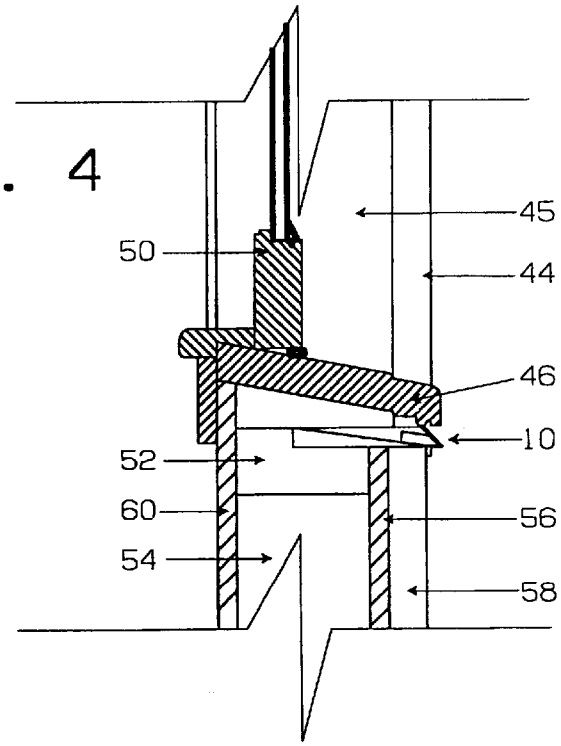
FIG. 4 is a sectional side view of a part of FIG. 3 along line 4—4, showing the position of the diverter under the window sill.

FIG. 4 is a sectional side view of the lower section of FIG. 3, showing diverter 10 positioned horizontally beneath window sill 46. Window sill 46 is supported by rough framing sill 52, which is supported by cripple 54. An interior sheathing 56 is covered with coated insulation board 58 lo form the wall cladding. As illustrated, diverter 10 is positioned in a slot directly beneath sill 46 and into a cut away area in rough sill 52.

When diverter 10 is in this position, any water entering window 40 and migrating downward will caught by diverter 10, where the water will then will flow along one or more of channels 32 and through discharge openings 34. In addition, openings 34 act as ventilation openings to facilitate reduction of the moisture content within the wall interior. On the other hand, the presence of filters 36 prevent external moisture, such as may result from rain, sleet or snow, from entering the wall interior.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A diverter for collecting water from beneath a wall component positioned in a building wall having a wall component mounting opening, a wall frame section beneath said opening, and an exterior wall, and discharging the water to the exterior of the wall, said diverter including:

a) a rear edge;

b) a front edge;

c) a water diverting surface sloping downwardly from said rear edge to said front edge, and said front edge being adapted to extend to at least the exterior surface of said wall when said diverter is beneath said wall component;

d) a plurality of spaced ribs having upper surfaces adapted to engage said wall component when said diverter is mounted in said wall beneath said wall component, said ribs in combination with said water diverting surface forming a plurality of open-topped channels extending from said rear edge to said front edge; and e) a lower surface parallel to said rib upper surfaces, said lower surface being adapted to rest on said wall frame section when said rib upper surfaces engage said wall component.

2. The diverter of claim 1, wherein said ribs are parallel.

3. The diverter of claim 1, wherein said ribs include forward sections extending beyond said front edge, and said diverter further includes a cover over the forward sections of said ribs, said cover in combination with said rib forward sections forming water discharge openings at the ends of said channels.

4. The diverter of claim 1, further including a stop extending downwardly from said lower surface and adjacent said front edge, said stop being adapted to engage the exterior of said wall when said diverter is positioned beneath said wall component.

5. An improved building comprising:

a) a wall having an opening, a wall frame section beneath said opening, and an exterior surface;

b) a wall component mounted in said opening; and c) a diverter positioned in said wall beneath said wall component, said diverter including a rear edge; a front edge; an upper water diverting surface sloping downwardly from said rear edge to said front edge, said upper water diverting surface extending at least to the exterior surface of said wall when said diverter is positioned beneath said wall component; a plurality of spaced ribs having upper surfaces engaging said wall component when said diverter is mounted in said wall beneath said wall component, said ribs in combination with said water diverting surface forming a plurality of open-topped channels extending from said rear edge to said front edge; and a lower surface parallel to said rib upper surfaces, said lower surface resting on said wall frame section.

6. The building of claim 5, wherein said diverter ribs are parallel.

7. The building of claim 5, wherein said diverter ribs include forward sections extending beyond said front edge, and said diverter further includes a cover over the forward sections of said ribs, said cover in combination with said rib forward sections forming water discharge openings at the ends of said channels.

8. The building of claim 5, wherein said wall component is a window.

9. The building of claim 5, wherein said diverter further includes a stop extending downwardly from said lower surface and adjacent said front edge, said stop engaging the outer surface of said exterior wall when said diverter is positioned beneath said wall component.

10. A method for removing water from a wall having an opening, a frame section beneath said opening, an exterior surface, and a wall component mounted in said opening comprising:

a) providing a diverter including a rear edge; a front edge; an upper water diverting surface sloping downwardly from said rear edge to said front edge, said upper water diverting surface extending at least to the exterior of said wall when said diverter is positioned beneath said wall component; a plurality of spaced ribs having upper surfaces adapted to engage said wall component when said diverter is mounted in said wall beneath said wall component, said ribs in combination with said water diverting surface forming a plurality of open-topped channels extending from said rear edge to said front edge; and a lower surface parallel to said rib upper surfaces, said lower surface being adapted to rest on said wall frame section when said rib upper surfaces engage said wall component; and b) positioning said diverter in said wall beneath said wall component with said rib upper surfaces beneath said wall component, and the lower surface resting on said frame section, whereby water migrating from said wall component will collect on said upper water diverting surface and be discharged to the exterior of said wall.

11. The method of claim 10, further including the step of cutting a slot in said wall beneath said wall component to receive said diverter.

12. The method of claim 10, sealant is applied between said diverter and said wall after positioning said diverter beneath said wall component.

13. The method of claim 10, wherein said ribs are parallel and include forward sections extending beyond said front edge, and said diverter further including a cover over the forward sections of said ribs, said cover in combination with said rib forward sections forming water discharge openings at the ends of said channels.

14. The method of claim 10, wherein said diverter further includes a stop extending downwardly from said lower surface and adjacent said front edge, said stop being adapted to engage the outer surface of said exterior wall covering when said diverter is positioned beneath said wall component.

15. A diverter for collecting water from beneath a wall component positioned in a building wall having a wall component mounting opening, a lower framing section beneath said opening, and an exterior wall, and discharging the water to the exterior of the wall, said diverter including:

a) a rear edge;

b) a front edge;

c) a water diverting surface extending from said rear edge to said front edge, said water diverting surface adapted to extend to at least to the exterior wall when said diverter is positioned beneath said wall component;

d) a plurality of spaced ribs extending above said water diverting surface, said ribs having upper support surfaces adapted to engage said wall component when said diverter is mounted in said wall beneath said wall component and forward sections extending beyond said front edge, said ribs in combination with said water diverting surface forming a plurality of open-topped channels extending from said rear edge to said front edge;

e) a lower surface parallel to said rib upper surfaces, said lower surface being adapted to rest on said lower framing section when said rib upper surfaces engage said wall component;

f) a cover over the forward sections of said ribs, said cover in combination with said rib forward sections forming water discharge openings at the ends of said channels; and g) filters in said channels at said discharge openings to prevent entry of water into said channels from said openings.

16. A method for removing water from a wall having an opening, a frame section beneath said opening, an exterior surface, and a wall component mounted in said opening comprising:

a) providing d diverter including a real edge; a front edge, a water diverting surface extending from said rear edge to said front edge, said water diverting surfaces extending at least to the exterior of said wall when said diverter is positioned beneath said wall component; a plurality of spaced ribs extending above said water diverting surface, said ribs having upper support surfaces adapted to engage said wall component when said diverter is mounted in said wall beneath said wall component and forward sections extending beyond said front edge, said ribs in combination with said water diverting surface forming a plurality of open-topped channels extending from said rear edge to said front edge, a lower surface parallel to the upper support surface of said rib upper surfaces, said lower surface being adapted to rest on said frame section when said rib upper surfaces engage said wall component; a cover over the forward sections of said ribs, said cover in combination with said rib forward sections forming water discharge openings at ends of said channels; and filters in said channels at said discharge openings to prevent entry of water into said channels from said openings; and b) positioning said diverter in said wall beneath said wall component with said rib upper surfaces beneath said wall component, and the lower surface resting on said lower frame section, whereby water migrating from said wall component will collect on said upper water diverting surface and be discharged to the exterior surface of said wall.

17. A diverter for collecting water from beneath a wall component positioned in a building wall having a wall component mounting opening, a wall frame section beneath said opening, and an exterior wall, and discharging the water to the exterior of the wall, said diverter including:

a) a rear edge;

b) a front edge;

c) a water diverting surface extending from said rear edge to said front edge, and said front edge being adapted to extend to at least the exterior surface of said wall when said diverter is beneath said wall component;

d) a plurality of spaced ribs leaving upper surfaces adapted to engage said wall component when said diverter is mounted in said wall beneath said wall component, said ribs in combination with said water diverting, surface forming a plurality of open-topped channels extending from said rear edge to said front edge, said channels having front ends terminating at said front edge, said ribs having forward ends;

e) a cover over the forward ends of said ribs, said cover in combination with said rib forward ends forming water discharge openings at the front ends of said channels; and f) a lower surface parallel to said rib upper surfaces, said lower surface adapted to rest on said frame section when said rib upper surfaces engage said wall component.

18. An improved building comprising:

a) a wall having an opening, a wall frame section beneath said opening, and an exterior surface;

b) a wall component mounted in said opening; and c) a diverter positioned in said wall beneath said wall component, said diverter including a rear edge; a front edge; all upper water diverting surface extending from said rear edge to said front edge, said upper water diverting surface extending at least to the exterior surface of said wall when said diverter is positioned beneath said wall component; a plurality of spaced ribs having upper surfaces engaging said wall component when said diverter is mounted in said wall beneath said wall component, said ribs in combination with said water diverting surface forming a plurality of open-topped channels extending from said rear edge to said front edge, said channels having front ends terminating at said front edge, said ribs having forward ends; a cover over the forward ends of said ribs, said cover in combination with said rib forward ends forming water discharge openings at the front ends of said channels; and a louver surface parallel to said rib upper surfaces, said lower surface resting on said wall frame section when said divider is mounted in said wall.

19. A method for removing water from a wall having an opening, a wall frame section beneath said opening, an exterior surface, and a wall component mounted in said opening comprising:

a) providing a diverter including a rear edge; a front edge; an upper water diverting surface extending from said rear edge to said front edge, said upper water diverting surface extending at least to the exterior of said wall when said diverter is positioned beneath said wall component; a plurality of spaced ribs having upper surfaces adapted to engage said wall component when said diverter is mounted in said wall beneath said wall component, said ribs in combination with said water diverting surface forming a plurality of open-topped channels extending from said rear edge to said front edge, said ribs having forward ends; a cover over the forward ends of said ribs, said cover in combination with said rib forward ends forming water discharge openings at the ends of said channels; and a lower surface parallel lo said rib upper surfaces, said lower surface being adapted to rest on said frame section when said rib upper surfaces engage said wall component; and b) positioning said diverter in said wall beneath said wall component with said rib upper surfaces beneath said wall component, and the lower surface resting on said frame section, whereby water migrating from said wall component will collect on said upper water diverting surface and be discharged to the exterior of said wall.

* * * * *